US006122868A

United States Patent [19]

Knezevich

[11] Patent Number: 6,122,868

[45] Date of Patent: Sep. 26, 2000

[54] ACCORDION SHUTTER SYSTEM

[76] Inventor: Vladimir John Knezevich, 641 Mokena Dr., Miami Springs, Fla. 33166

[21] Appl. No.: 08/903,335

[22] Filed: Jul. 30, 1997

Related U.S. Application Data

[63] Continuation of application No. 08/658,869, May 31, 1996, abandoned.

[51] Int. Cl.[7] ..... E06B 3/26

[52] U.S. Cl. ..... 52/202; 49/61; 49/409; 160/183

[58] Field of Search ..... 52/202, 109; 49/61, 49/409; 160/183, 199, 206

[56] References Cited

U.S. PATENT DOCUMENTS

| | | | |
|---|---|---|---|
| 4,333,271 | 6/1982 | Depaolo et al. | 52/202 X |
| 4,660,613 | 4/1987 | Dagenais | 160/183 X |
| 5,426,893 | 6/1995 | Hoffman | 52/202 X |
| 5,469,905 | 11/1995 | McKinney et al. | 160/35 |
| 5,477,903 | 12/1995 | Figueirdo et al. | 160/183 |
| 5,522,445 | 6/1996 | Hoffman | 160/206 X |
| 5,540,018 | 7/1996 | Biggers | 52/202 |
| 5,549,148 | 8/1996 | Figuerdo et al. | 160/233 X |
| 5,566,739 | 10/1996 | Hoffman | 160/233 X |
| 5,575,322 | 11/1996 | Miller | 160/183 X |

*Primary Examiner*—Creighton Smith
*Attorney, Agent, or Firm*—Lott & Friedland, PA

[57] ABSTRACT

An accordion shutter system comprising a plurality of continuously extruded, substantially rectangular accordion shutter blades having opposing vertical sides wherein one vertical side of each the shutter blade consists of a male end and the opposite vertical side of each the shutter blade consists of a female end such that the male end of adjacent the shutter blades interlocks with the female end of the shutter blade therein forming a triple interlocking hinge; means for laterally deploying and stacking the accordion shutter system; means for connecting the shutter blades to each other when the accordion shutter system is fully deployed; and means for connecting the shutter blades to a horizontal or vertical surface. The male end of the triple interlocking hinge comprises a male partial circle and the female end comprises a female partial circle wherein the male partial circle is smaller in diameter than the female partial circle and the male partial circle has two outward protruding exterior hooks on its outer periphery that fit inside the female partial circle and wherein the male partial circle has a notch that protrudes from an offset arm of the male end.

1 Claim, 15 Drawing Sheets

ACCORDION SHUTTER SYSTEM

CROSS-REFERENCE TO RELATED APPLICATION

This is a continuing application from U.S. Pat. application Ser. No. 08/658,869, filed May 31, 1996, which was abandoned Jul. 22, 1997.

BACKGROUND OF THE INVENTION

1. Field of the Invention

This invention relates to an accordion shutter system that is especially resistant to hurricane force winds and flying objects when used to cover doors, windows or openings. This accordion shutter system also offers a unique ability to secure doors, windows and openings from forced entry.

2. The Prior Art Background

In coastal and non-coastal areas subjected to high winds and flying objects from wind and rain storms, tornados, hurricanes or typhoons, accordion shutters traditionally have been used that lacked the strength to resist flying objects like a 9 pound 2×4 traveling at 34 M.P.H. Some accordion shutters are much larger in blade length, and component thickness, while actually being weaker. Others are very heavy and bulky causing considerable difficulty in operation, have large protrusions from the wall when stacked and difficulty walking over the wide bottom track when used across doorways and are extremely expensive and unattractive. Accordion shutters have historically required two or three guide pins per blade, with one or two rows of these guide pins following the outside of a top and bottom guide track while another rides in a groove. There has been a need for accordion shutters built for wide openings to be manufactured in sections that can be assembled in the field. This invention addresses the shortcomings of previous accordion shutters by providing the resistance to high winds (Minimum of 160 M.P.H. on all traditional home doors and windows), a 2×4 traveling at 34 M.P.H., very low weight per square foot of deployed shutter system, lightweight and easy to operate, minimal protrusion from wall when stacked at edges of opening, compact stacking of blades, ease of maintenance for guide pins, trolley and blade replacement and the capability of the accordion shutter to be assembled, from factory assembled smaller sections, in the field, by snapping the blades together. This facilitates the installation of very wide shutters without undue weight problems for the installer. Another unique feature is the use of a single row of guide pins and trolleys for shutter operation, therein allowing narrower top and bottom guides that do not need to be the width of the deployed blade. This feature offers less obstruction and therefore more safety to those who would have to walk across these tracks at doorways.

SUMMARY OF THE INVENTION

The inadequacies of prior art accordion shutter systems are addressed and corrected by the present invention which provides a unique accordion shutter system that is lightweight, attractive, inexpensive, very sturdy, stackable in a very small space, limited protrusion from wall when stacked, has a totally unique triple interlock at the knuckle to hold blade together for resistance to high winds and impact, conforms with the 1994 South Florida Building Code, the 1994 South Florida Building Code-Broward County, Florida version and the 1994 Standard Building Code. The invention, a unique accordion shutter system is made up of a top, single mounting flange guide pin track that mounts to a wall surface with fasteners. The invention further utilizes a bottom, single flange guide pin track mounted to a wall surface or a single flange guide pin track mounted to a horizontal surface. The hinged vertical blade, is supported at every other knuckle by a top dual wheeled trolley with guide pin and screw assembly while a guide pin and screw is used in the remainder of the top blade knuckles that align with the top guide track. A bottom guide pin and screw is installed in each knuckle, that aligns with the groove in the bottom track. The knuckles that do not align with the groove in the track receive screws to secure the connection of the male and female edges of the blade, but do not receive guides. These trolleys and guides follow their respective top and bottom guide tracks for operation. The blade is basically rectangular in appearance but when viewed as a section through the blade has female and male ends. The female end is comprised of about 275 degrees of a circle forming the outside of the hinge or knuckle. The outside of this knuckle is smooth while the inside has two internal hooks or stops protruding inward from the inside surface of the female partial circle. The male end is also a smaller partial circle with two outward protruding hooks or stops that fit inside the female section. The male end is also the end of the blade that receives the dual trolley wheels or guide pin. The male end of the blade is especially shaped to allow for an external interlock at the knuckle. There is a notch in the short, offset, thickened arm of the male end of the blade that allows the female end of the blade to fit inside when the blades are open or deployed to offer protection. The use of all three locking mechanisms limits the blade opening to about 90 degrees.

The shutter members, when deployed, are arranged in a continuous v pattern (sinusoidal in appearance), which follows the header and sill grooves. The edge portions of adjacent shutter members are connected so as to allow each blade to rotate with respect to the adjacent blades.

The shutter system may include one or more arrays of sinusoidal configured shutter assemblies. These arrays may be connected to a wall, column, structural stop, or to each other. This connection when made between two arrays is made up of two centermate sections. These centermates are slid longitudinally into the shutter blade and are interlocked with the shutter blades at the male/female hinge and are configured to interlock with one another upon deployment or closure of the shutter system.

One of the centermates has a female lock section while the other centermate has a male lock section. Mechanical locks may be added to the centermate sections. These locks may be cylindrical, pinned or hooked. Locks are not needed when the two centermates close into one another and are held in place by vertical pins that slide within the centermate extrusion, in partially cylindrical cavities that run the length of the centermate extrusion. These pins are slide into the header and sill tracks, which are punched or drilled to a size sufficient to receive the pins.

On each end of the shutter array there are starter strips that allow the shutter to be attached to a wall, column or mullion. This starter strip has a 180 degree or a 90 degree flat mounting surface on one side while offering the same female cylindrical section as found on the blades on the other side. This facilitates the attachment of the blade to a wall, column or mullion.

Wall mounted headers are basically a rectangular section with a flange at one top end and a continuous notch in the center of the bottom that receives the wheels of the trolley assembly and a guide pin. The wall mounted headers that receive the pin/trolley/blade assembly are designed to be mounted from this single flange on top of the wall header. The headers may include receivers for felt strips on either side of the notch that receives the pin or trolley assembly and an optional rain cover which is a protruding flange emanating from the diagonally opposite corner as the mounting flange, that serves as a cover for the shutter blade array, when installed in the header.

Ceiling mounted headers are basically a rectangular section with a continuous notch in the center of the bottom that receives the wheels of the trolley assembly and a guide pin. The ceiling mounted headers that receive the pin/trolley/blade assembly are designed to be mounted from the top. The headers may include receivers for felt strips on either side of the notch that receives the pin or trolley assembly. These strips allow easier and quieter operations. Ceiling mounted headers may be used with various equal or unequal angles to achieve desired shutter array mounting offsets from walls. The angle is mounted to the wall and the ceiling header is fastened to the under side of the angle in the desired location. Ceiling mounted headers may also be used as sills. The ceiling header may be inverted or rotated 90 degrees and used as a sill to receive the guide pins on the bottom of the shutter array in either a trapped or slab mount condition or may be used as an offset sill by utilizing an equal or unequal angle mounted to a wall with the inverted ceiling header fastened to the top of the angle in the proper alignment to receive the bottom guide pins from the shutter assembly.

The wall mounted sill is basically an angular cross section with notch or groove configuration setting on top of the angle to receive the guide pin assemblies. The wall mounted sill can be mounted from a singular flange positioned below the shutter for ease of access. This flange can be wall mounted in the desired vertical location to effect the proper blade clearances for optimum performance and operation.

The adjustable sill is a two piece receiver for the guide pin assemblies. Each piece is shaped in a channel configuration. The top piece has a notch or groove formed into the wide part of the horizontal part of the channel section and this top piece fits into the bottom piece with overlapping vertical sections that allow the top section to be raised as needed to achieve the proper blade to sill clearances for optimum shutter performance and operation. When proper clearances are determined and the part adjusted, screws, rivets or bolts may be used to secure the relative positions of the two components of this adjustable sill. The adjusted and fastened adjustable sill assembly now has a rectangular appearance with the long flat bottom section anchored to the floor or wall mounted unequal angles and the top long side has the groove looking up to the shutter guide pin and blade assembly.

DETAILED DESCRIPTION OF THE PREFERRED EMBODIMENTS

Figure 1:
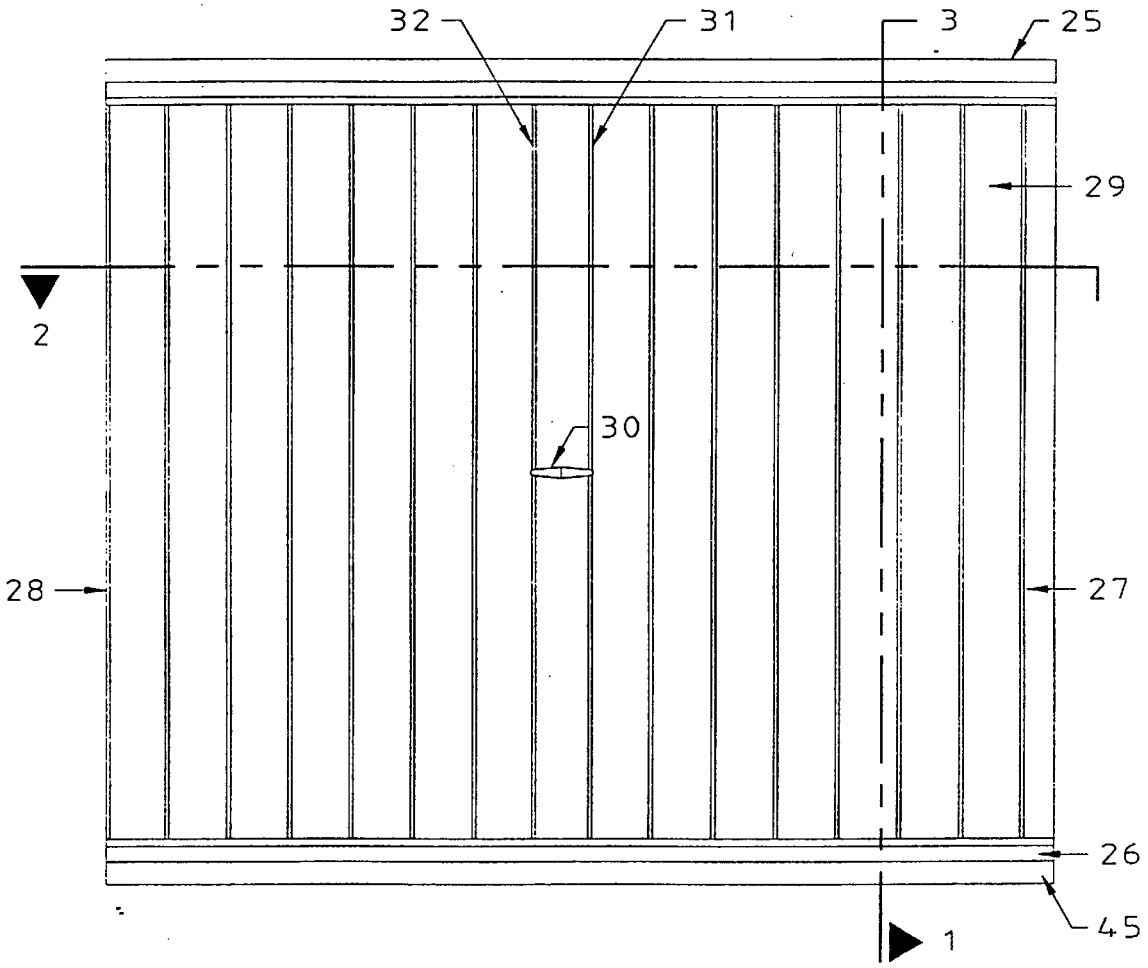
FIG. 1 is an elevation of the deployed accordion shutter system, with a locking mechanism shown in the middle. This locking mechanism may be on either side instead of in the middle.
Figure 2:
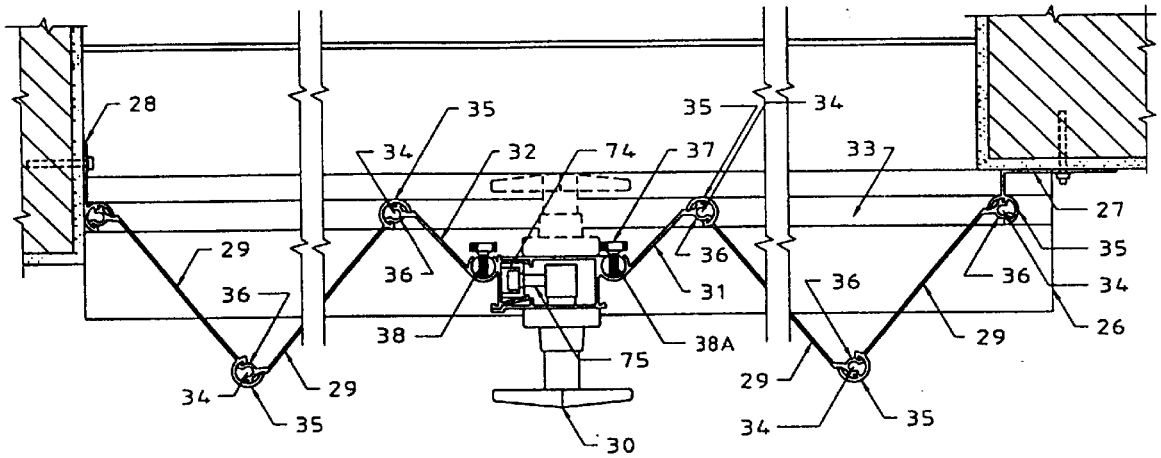
FIG. 2 is a plan view of a deployed accordion shutter system, showing the 90 degree starter strip on one side and the 180 degree starter strip on the other. The two sinusoidal arrays are connected in the middle by interlocking, male and female centermates, utilizing a 90 degree handle locking or latch mechanism.

An elevation of the accordion shutter system which embodies this inventions is shown in FIG. 1. The accordion shutter system is made up of a plurality of interlocking blades 29 riding in and guided by an elongated header 25 and an elongated adjustable sill assembly 26 & 45. The system includes an optional, 90 degree starter strip 28 at one side and an optional, 180 degree starter strip 27 on the other side. The shutter system is held together by elongated and interlocking, male centermate 32 and a female elongated and interlocking centermate 31 held together by a mechanical lock 30 and or locking pins that slide in elongated slots 38 and 38A that can best be seen in FIG. 2. These locking pins are round aluminum rods that slide into the elongated header 25 and into the top section of the bottom sill 26, again as seen in FIG. 2. FIG. 2 shows the shutter blade 29 with its male 36 and female 35 ends, interlocked. This interlocking of accordion blade ends, creates the hinge mechanism that allows this shutter system array to vary in width as may be required. The deployed shutter system across an opening, appears as a sinusoidal pattern when seen as a plan view from above, as in FIG. 2.

Figure 3:
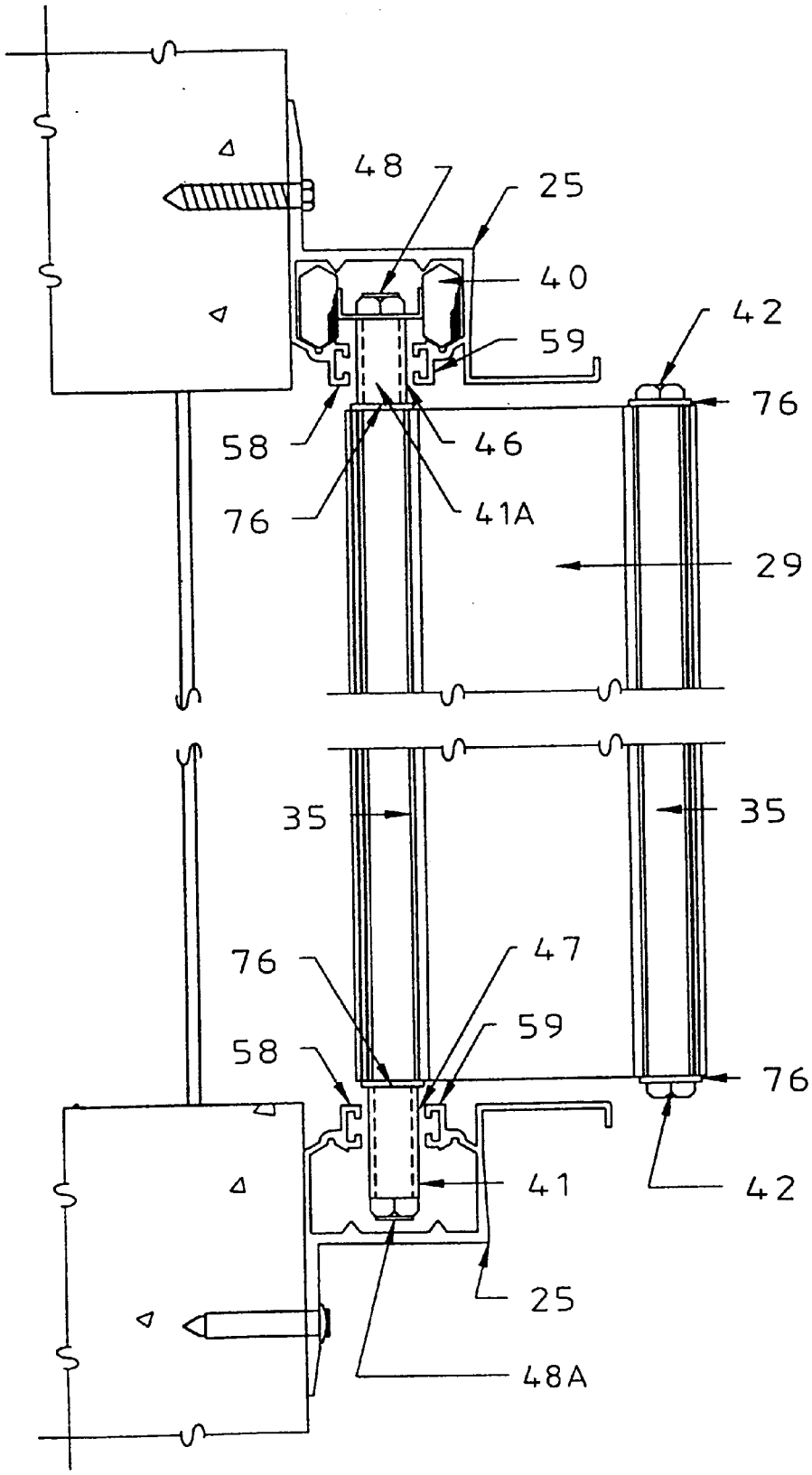
FIG. 3 is a cross section of a wall mounted accordion shutter system. The header and sill are mounted on a wall with a masonry, wood or metal fastener. The accordion shutter is shown riding on a trolley wheel that slides in the extruded header and is screwed into the blade hinge, at the top of the blade. The bottom of the accordion shutter blade is guided by the pin screwed into the bottom of the accordion shutter blade and tracking in the groove of the wall mounted sill. Headers may also be used as sills.

The screws 48 and 48A, that connect each interlocking shutter blade to another and provide the follower mechanism that allows the shutter system when being deployed or stacked, to follow the grooves 46 and 47 shown on FIG. 3. Screw 48, installed through the trolley assembly 40, tube 41A, washer 76 and into part 34 of the male end of the hinge 36. This holds the trolley assembly 40 to the elongated interlocking shutter blades 29 at every other blade hinge 35. Every other blade hinge 35 following a groove 46, 47, 46A, 63, 63A in a track (header 25,43 or sill 25,26,44) has simply a guide pin composed of a ¼" diameter screw 48A and nylon or plastic hollow tube 41,41A and washer 76. The trolley assembly 40 carries the weight of the shutter in the header 25 and allows ease of movement in either of two directions, when deploying or stacking shutter system. All other blade hinges 35 are connected to each other with the ¼" diameter screws 42 and a washer 76. The wall mount assembly shown on FIG. 2 shows and elongated header 25 and header 25 may also be used as a sill by inverting before installing. When wall mounting, the shutter array may be slid into the header 25 and sill 26 and 45 after the header 25 and sill 26 and 45 have been mounted to the wall.

Figure 4:
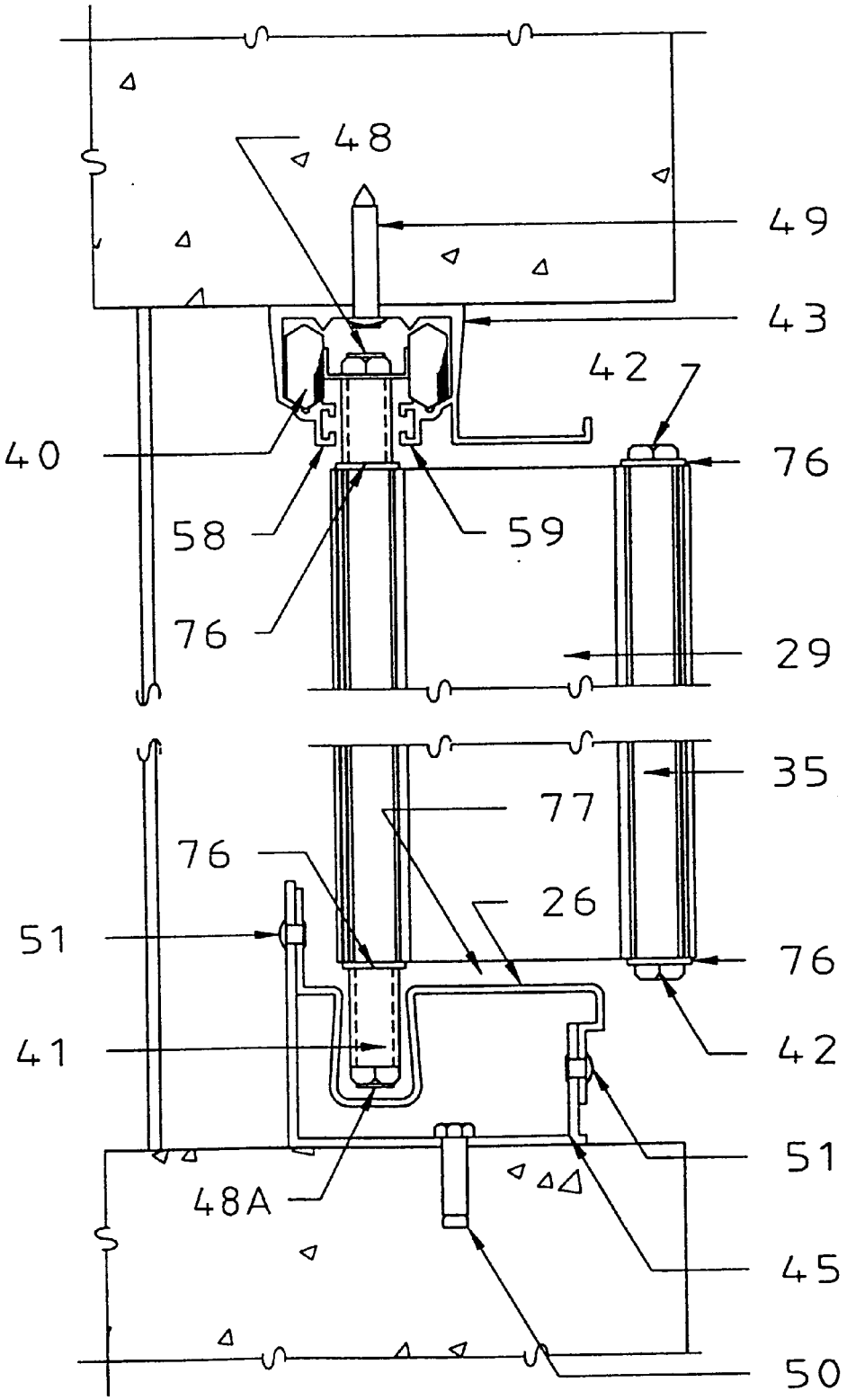
FIG. 4 is a cross section of a trap mounted header and an adjustable sill. Fasteners anchor the header and sill to the masonry, wood or metal above and below the accordion shutter.

FIG. 4 shows a trapped accordion shutter, continuously extruded, header mounting installation, wherein the shutter system has fixed boundaries, typically the vertical sides of the opening to be protected. The header 40 is fastened to the ceiling with an appropriate fastener 49, typically at 12" on center. The adjustable sill 26 and 45 are also fastened to the concrete or wood floor with an appropriate fastener 50. The two parts of the adjustable sill 26 and 45 are fastened together with tek screws 51 or rivets. The shutter blades 29 are slid into the header before mounting same. The shutter array can be hinged in or out to allow placement and anchoring of the adjustable sill assembly 26 and 45.

Figure 5:
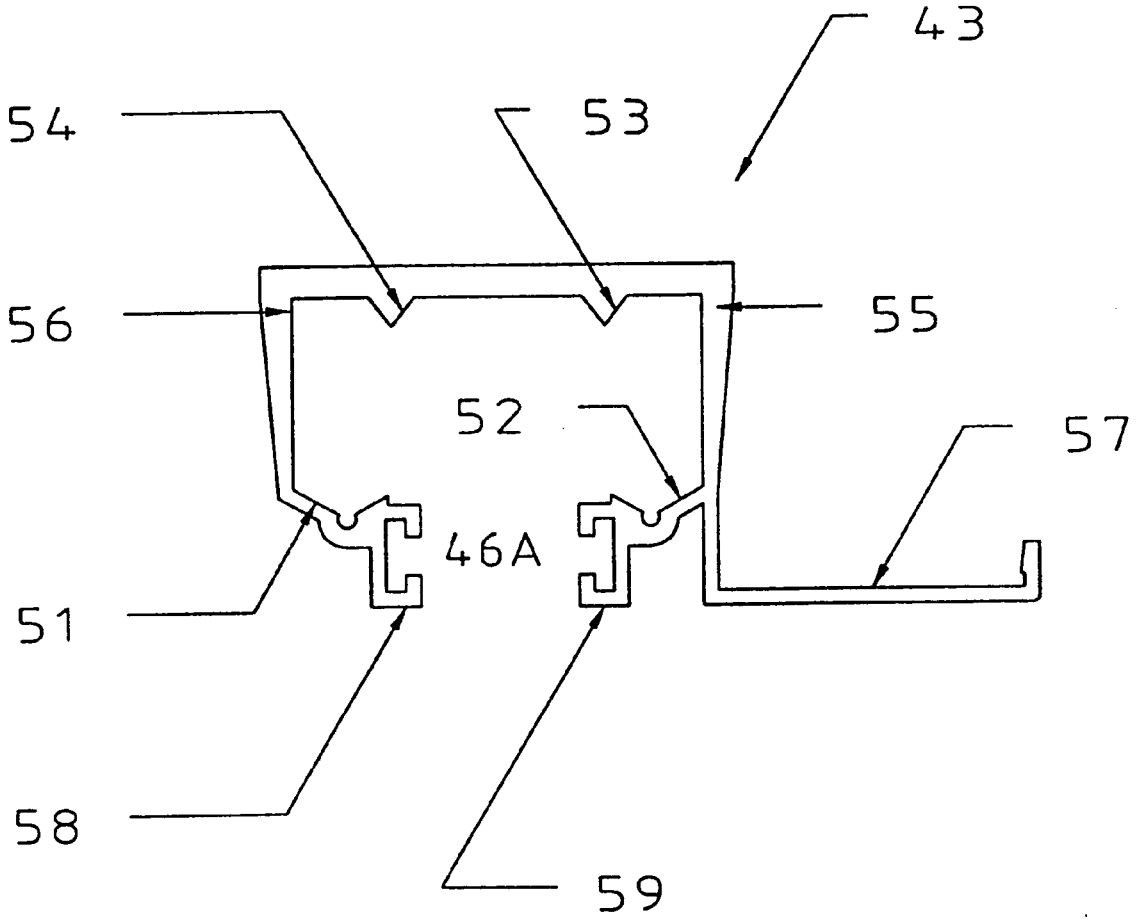
FIG. 5 is a cross sectional view of an extruded header or sill to be used in trapped mounting conditions or wall mounting when used with equal or unequal angles for the shutter system.

FIG. 5 clearly defines the continuously extruded header 43 used in a trapped mounting condition. The trolley wheel seats 51 and 52 are symmetrical about the vertical centerline of this part. The "V" shaped protrusions 53 and 54 are also located symmetrically about the vertical centerline of this part. These help maintain alignment of the trolley wheels when they are rolling. The sides 54 and 55 of this header 43 are tapered for maximum strength while minimizing weight and therefore cost. The rain cover 57 is an optional flange. This shutter system does not use this flange for any structural support or for pin guidance. The receptacles 58 and 59 are optional, but when filled with felt or plastic, do provide easy and quiet operation of the shutter system, while reducing maintenance and wearing of parts due to friction.

Figure 6:
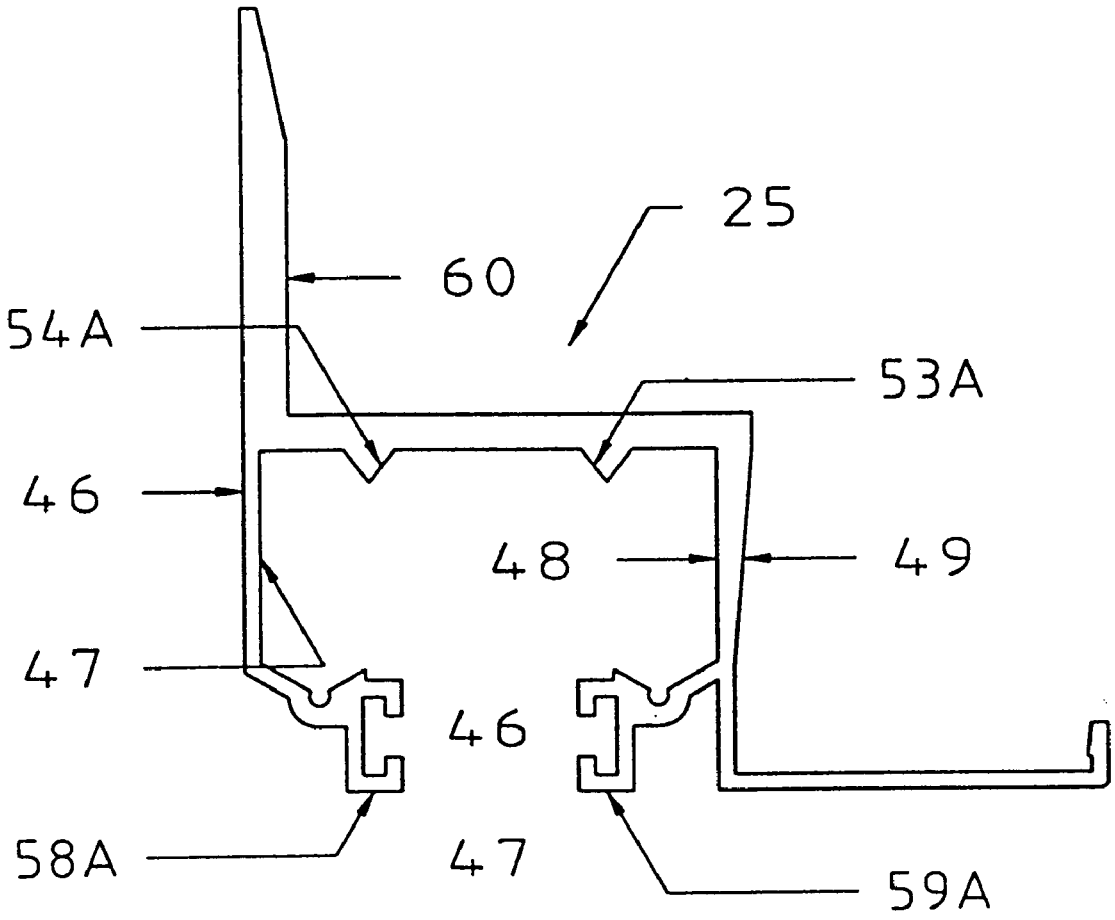
FIG. 6 is a cross sectional view of an extruded, wall mounted header or sill for the shutter system.

FIG. 6 clearly defines the wall mounted header 25. This header is continuously extruded and has all of the features of the trapped mount header 43 described above, with a single flange wall mounting arm 60 turned up. This allows installations to be quicker, easier and more economical because the total shutter length has been reduced over those systems that require flanges on top of and below the header. Rain guard again is optional. The receptacles 58A and 59A are optional, but when filled with felt or plastic, do provide easy and quiet operation of the shutter system, while reducing maintenance and wearing of parts due to friction.

Figure 7:
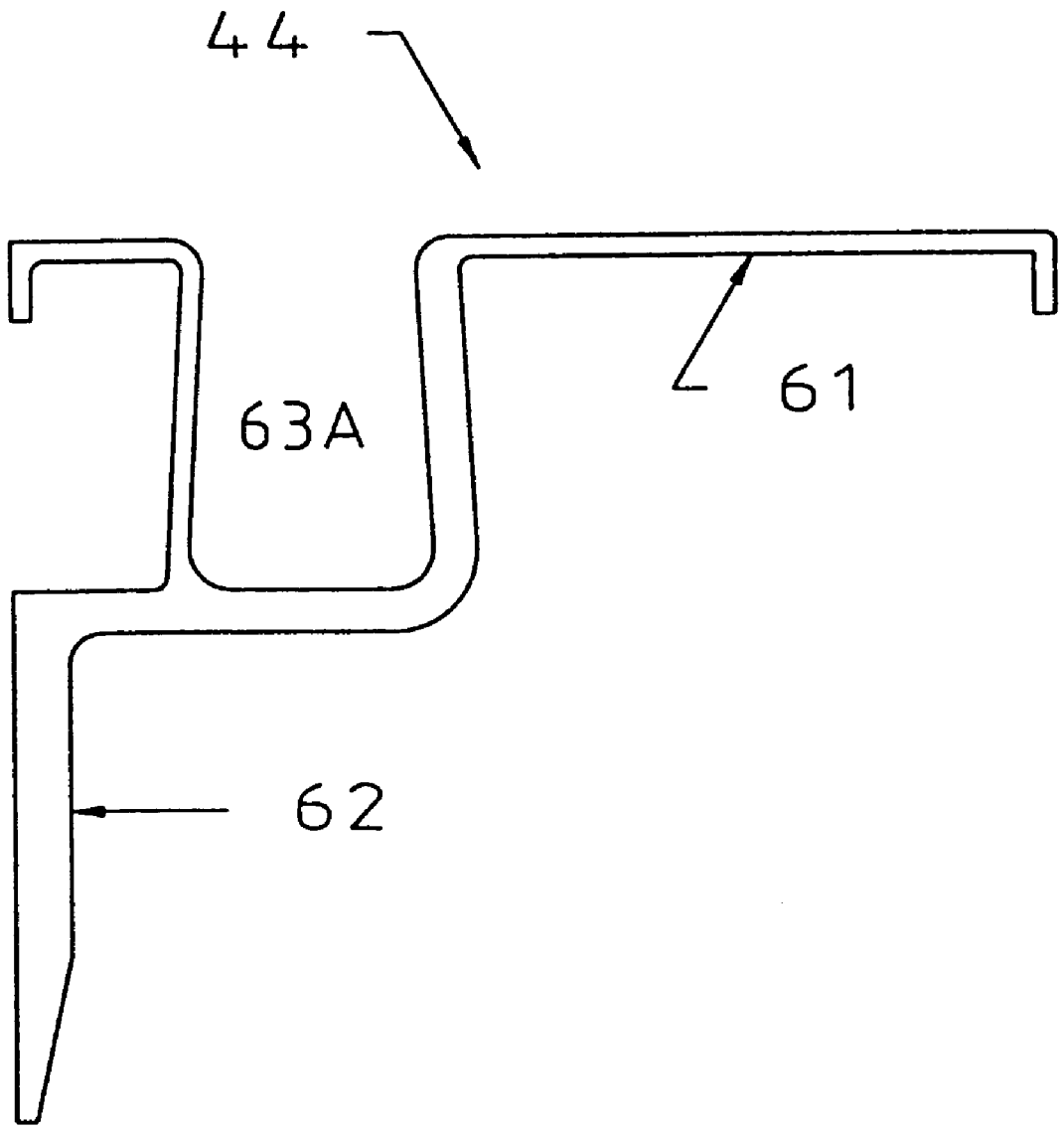
FIG. 7 is a cross sectional view of an extruded, wall mounted sill for the shutter system.

FIG. 7 clearly defines a wall mounted sill 44. This component is a continuous extrusion and receives the screw 48A and tube 41, protruding from the bottom of the accordion shutter blade 29 into the groove that acts as a guideway for the lateral movement of the shutter array. This sill 44 has a single mounting flange 62 turned down for easy, quick and economical installations. Rain guard 61 is optional as it performs no structural duties. Groove 63A is a receiver for guide pin 41,48A.

Figure 8:
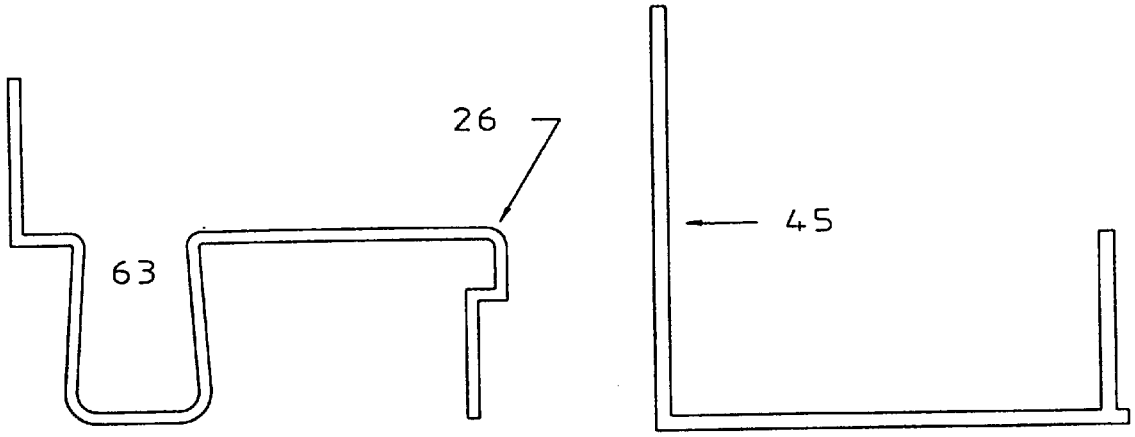
FIG. 8 is a cross sectional view of an extruded, trapped mount or wall mount when used with equal or unequal angles, two piece, adjustable sill for the shutter system.

FIG. 8 clearly defines the two component adjustable sill. This sill is made up of a continuously extruded top section 26 and a continuously extruded bottom section 45. 26 slides up or down in 45. These two parts are finally secured with tek screws or rivets 51 when the blade clearance 77 to the sill is correct. The groove 63 in the top section 26 provides the guideway for the lateral movement of the shutter array.

Figure 9:
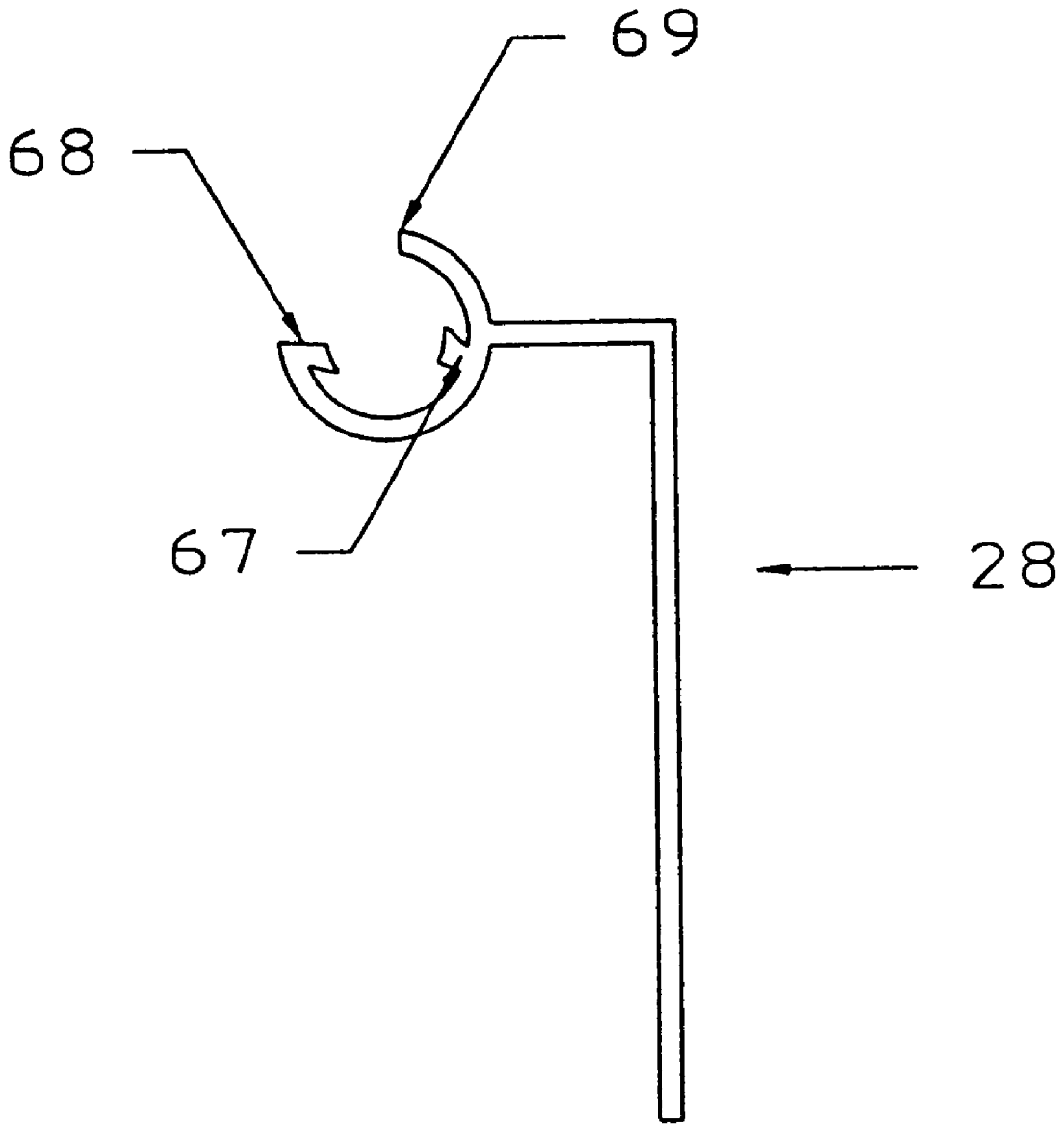
FIG. 9 is a cross sectional view of an extruded, wall mounted, 90 degree starter strip.

FIG. 9 clearly defines the 90 degree starter strip 28. This component is a continuous extrusion that allows the shutter array to be attached to a wall.

Figure 10:
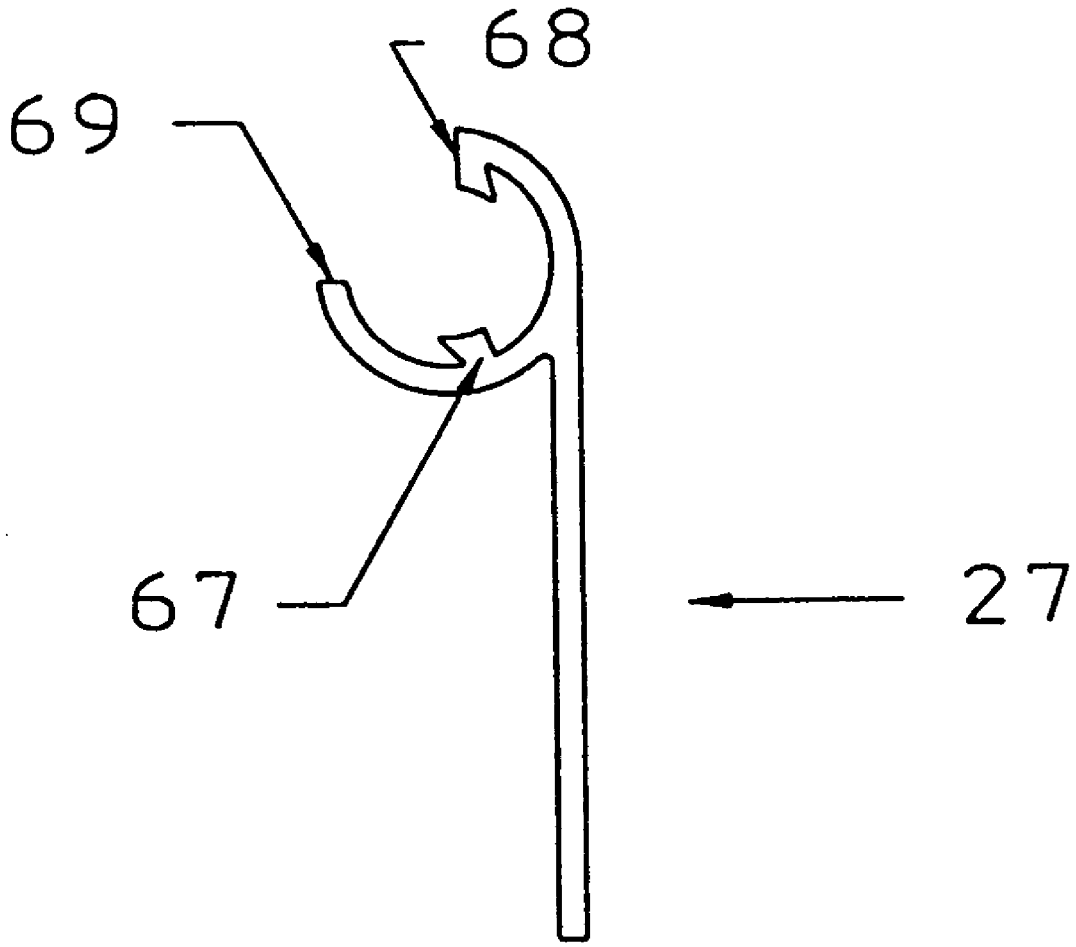
FIG. 10 is a cross section view of an extruded, wall mounted, 180 degree starter strip.

FIG. 10 clearly defines the 180 degree starter strip 27. This component is a continuous extrusion that allows the shutter array to be attached to a wall.

Figure 11:
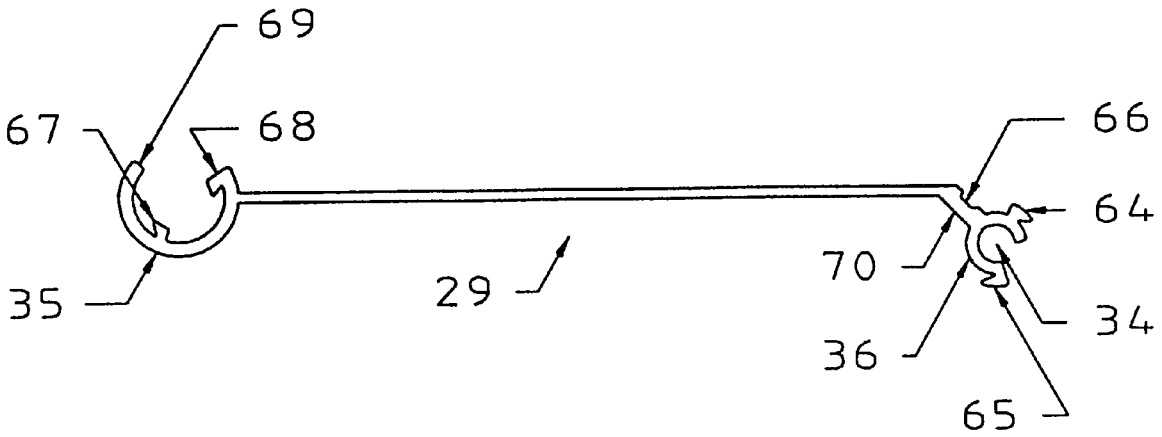
FIG. 11 is a typical cross section of an extruded blade with a male end and a female end. Each end makes up one half of the hinge mechanism.

FIG. 11 clearly defines a continuously extruded accordion shutter blade 29. This component has male 36 and female 35 ends that allow the shutter to interlock forming a hinge (See FIG. 14 and FIG. 15). This hinge is made up a male section with two hooks 64 and 65 on the outside of the engaging portion and one notch 66 on the offset arm. The female section has two hooks 67 and 68 that engage the two hooks 64 and 65 in the male section and the end of the female section 69 rests in the notch 66 of the offset arm 70 when the shutter is deployed. This triple interlock of the hinge gives it the most unique impact, cycling and wind resistance in the industry today. The center of the male end 34 of the blade 29 is the receptor for the ¼ diameter screw 42, 48, 48A that with the use of a washer 76 or washer and tube 41, 41A, respectively holds the blades together.

Figure 12:
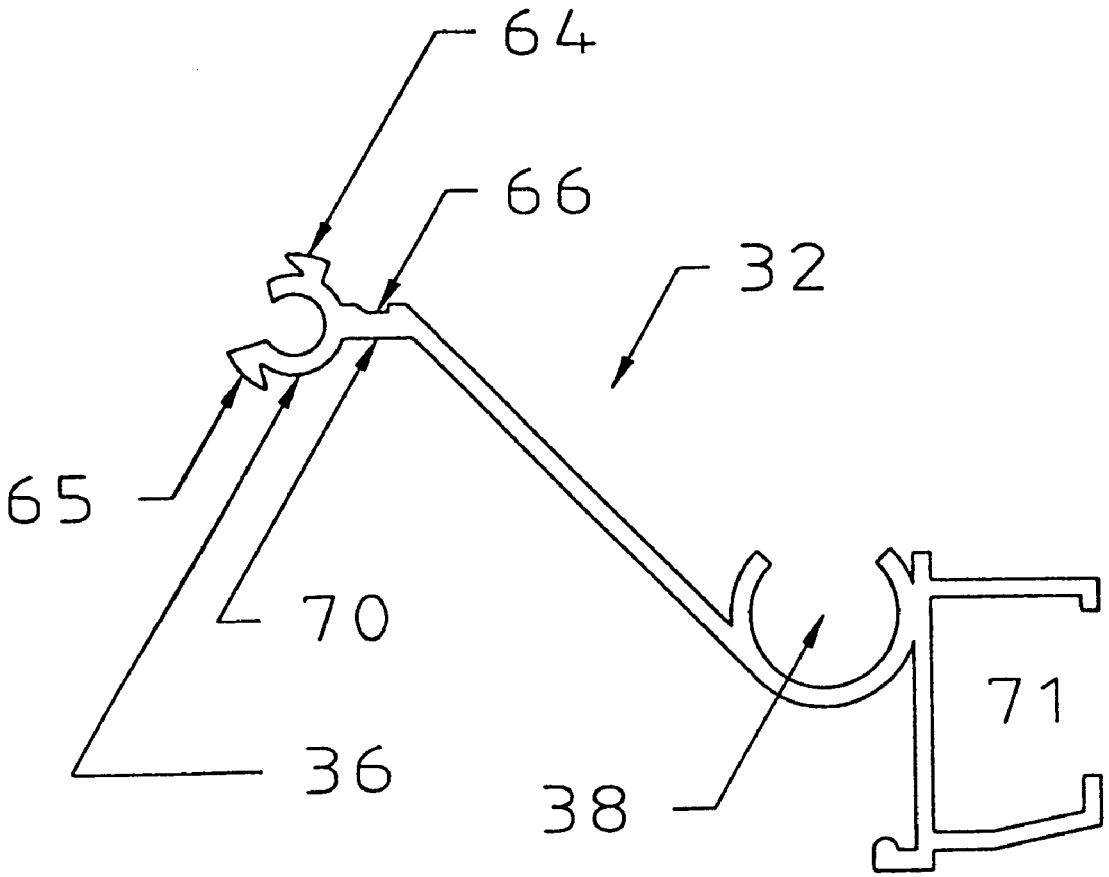
FIG. 12 is a cross section of the extruded male centermate, with the male hinge mechanism and the cylindrical cavity for the slide pin.

FIG. 12 clearly defines the male centermate 32, with its male accordion blade end 36, the locking pin slot 38 and the male portion of the lock 71 which receives the cast aluminum receiver 74 as shown in FIG. 2.

Figure 13:
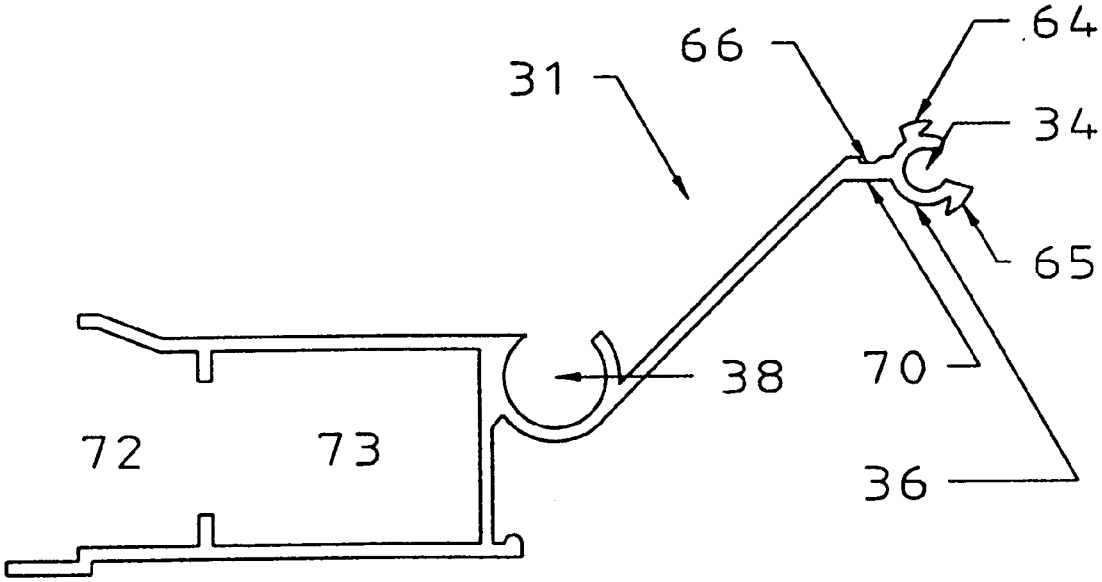
FIG. 13 is a cross section of the extruded female centermate, with the male hinge mechanism and the cylindrical cavity for the slide pin.

FIG. 13 clearly defines the female centermate 31, with its male accordion blade end 36, the locking pin slot 38 and the female portion of the lock 72. 73 houses the handle lock 30 and the locking arm 75.

Figure 14:
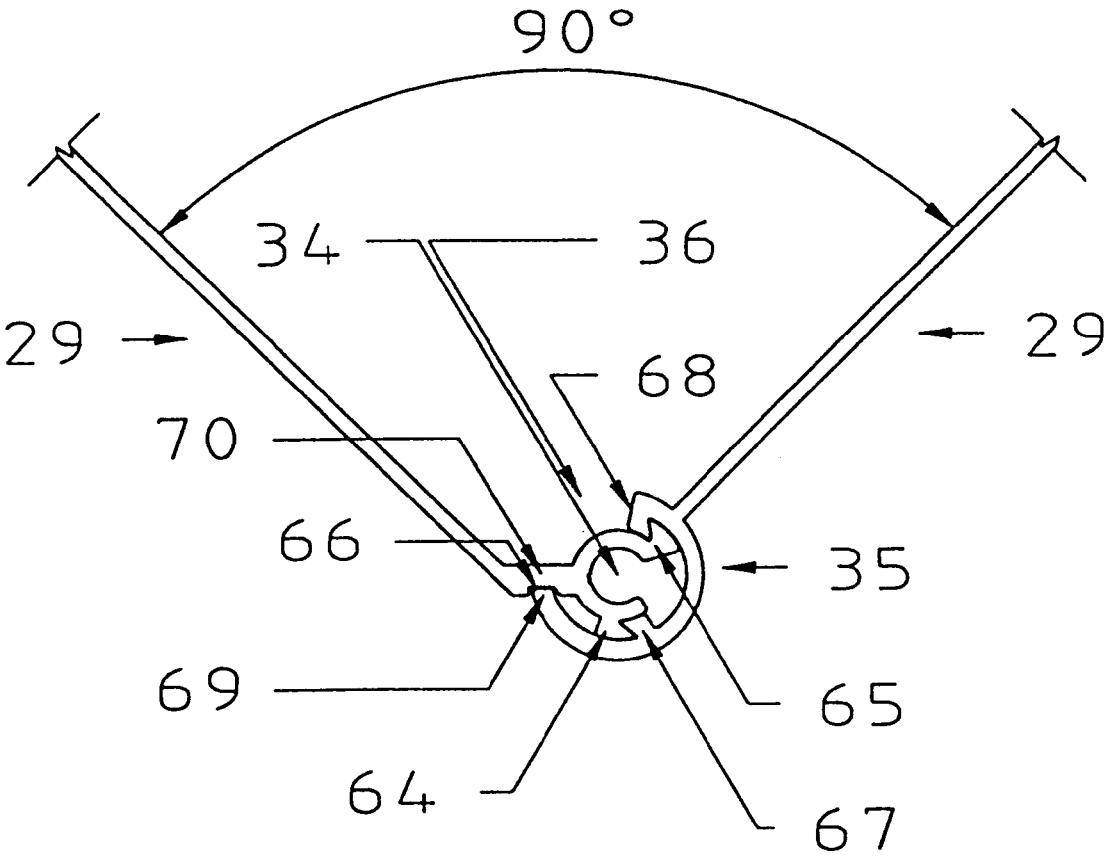
FIG. 14 is a cross section of the male and female mechanism of typical shutter blades, in the nearly deployed condition.

FIG. 14 clearly shows the continuous, vertical, interlocking hinge in detail. Male end 36 and female end 35 are in the full deployment position, with the triple locks, 64,67; 65,68; and 66,69 fully engaged.

Figure 15:
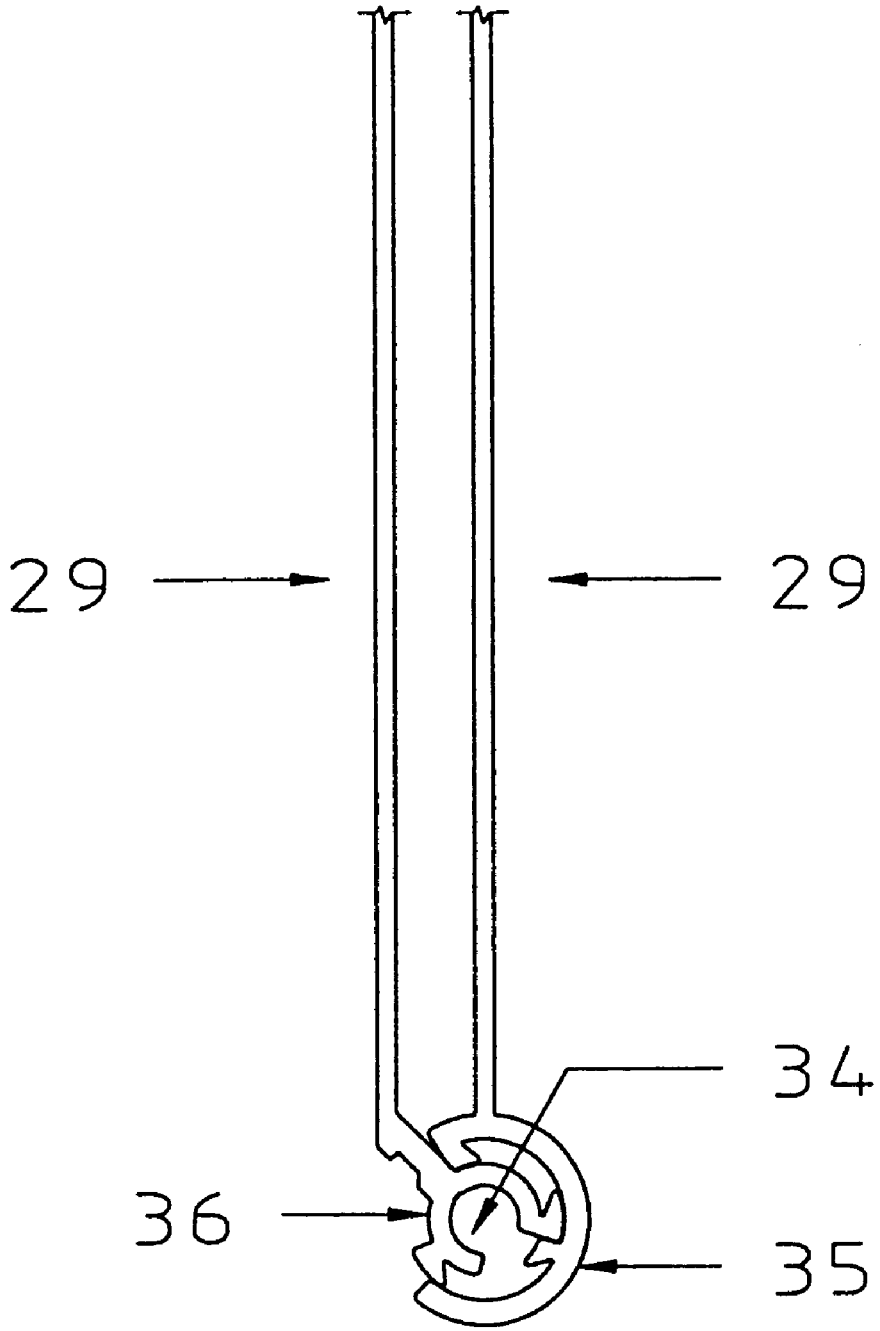
FIG. 15 is a cross section of the male and female mechanism of typical shutter blades in the stacked position.

FIG. 15 clearly shows the stacked position of the blades 29 with the relative positions of the continuous, vertical, interlocks created by the male 36 and female 35 ends.

I claim:

1. An accordion shutter system, comprising:

a plurality of adjacent continuously extruded, substantially rectangular accordion shutter blades having opposing vertical sides, wherein one vertical side of each said shutter blade consists of a male end and an opposite vertical side of said shutter blade consists of a female end such that said male end of adjacent shutter blades interlocks with said female end of said shutter blade therein forming a triple interlocking hinge;

said male end of said triple interlocking hinge comprises a male partial circle with two outward protruding exterior hooks on its outer periphery and a notch that protrudes from an offset arm of said male end;

said female end comprises a female partial circle with a first and a second interior hook sized to accept said male partial circle thereby creating said triple interlocking hinge, whereby said outward protruding exterior hooks of said male partial circle engage said first and second interior hooks of said female partial circle and one of said interior hooks of said female partial circle engages said notch that protrudes from said offset arm of said male end;

an elongated continuously extruded header having a vertical centerline wherein two longitudinally running trolley wheel seats extend the length of said header, one on each side of said header's vertical centerline;

a trolley assembly attached to every other said triple interlocking hinge wherein trolley wheels ride in said trolley wheel seats;

a plurality of protruding guide pins connected to the same said triple interlocking hinges as said trolley assembly but disposed in the opposite direction;

a continuously extruded sill forming a channel configuration connectable to a horizontal or vertical surface;

said header further comprises two longitudinally running receptacles extending the length of said header, one on each side of said header's vertical centerline, wherein each said receptacle faces said trolley wheels when inserted into said receptors of said header, and receives felt or plastic to provide quieter deployment or stacking of said accordion shutter system;

an elongated male centermate having said male end of said shutter blade for receiving said female end of said shutter blade, a locking pin slot and a male portion of said lock;

an elongated female centermate having said male end of said shutter blade for receiving said female end of said shutter blade, a female portion of said lock for receiving said male portion of said lock and said locking pin slot; and a continuously extruded starter strip, shaped at 90 degrees or 180 degrees, having a female cylindrical section similar to said female end of said shutter blade for receiving said male end of said shutter blade and a flat mounting surface to abut against said horizontal or said vertical surface.

* * * * *